US011944169B2

(12) United States Patent
Gandia

(10) Patent No.: US 11,944,169 B2
(45) Date of Patent: Apr. 2, 2024

(54) EARRING AND EARRING BACK

(71) Applicant: Robyn Gandia, Maxville (CA)

(72) Inventor: Robyn Gandia, Maxville (CA)

( * ) Notice: Subject to any disclaimer, the term of this patent is extended or adjusted under 35 U.S.C. 154(b) by 0 days.

(21) Appl. No.: 17/725,256

(22) Filed: Apr. 20, 2022

(65) Prior Publication Data

US 2022/0330665 A1 Oct. 20, 2022

(30) Foreign Application Priority Data

Apr. 20, 2021 (CA) ..... CA 3115610

(51) Int. Cl.
*A44C 7/00* (2006.01)

(52) U.S. Cl.
CPC ..... *A44C 7/002* (2013.01); *A44C 7/003* (2013.01)

(58) Field of Classification Search
CPC ..... Y10T 24/367; Y10T 24/3672; Y10T 24/4605; Y10T 24/4629; A44C 25/001; A44C 17/0208; A44C 7/002; A44C 7/003; A44C 7/004; A44C 15/003; A44C 15/001; A44C 25/00
USPC ..... 63/35; D11/87, 88
See application file for complete search history.

(56) References Cited

U.S. PATENT DOCUMENTS 666,735 A * 1/1901 Capewell ..... A44C 7/003 63/20
1,258,313 A * 3/1918 Broyles ..... A44C 15/003 24/13
2,373,499 A * 4/1945 Passanante ..... A44C 25/00 446/28
2,954,593 A * 10/1960 Matelan ..... A44C 1/00 24/350
3,088,295 A * 5/1963 Haines ..... A44B 1/28 63/29.1
3,343,230 A * 9/1967 Darvie ..... A44B 1/14 D11/95
3,443,398 A 5/1969 King, Jr.
4,218,894 A * 8/1980 Tropea ..... A44C 7/003 63/29.1
4,265,098 A * 5/1981 Wayne ..... A44C 3/008 63/3
4,382,317 A * 5/1983 McDonald ..... A44C 7/003 63/12
4,763,489 A * 8/1988 Strong ..... A44C 15/001 24/698.3
5,048,311 A * 9/1991 Mastrobuono ..... A44C 15/001 63/29.1
5,337,584 A * 8/1994 Angeli ..... A44C 15/001 63/1.17
5,588,309 A 12/1996 Chioffe
D423,978 S * 5/2000 Kohl ..... D11/87
6,381,985 B1 * 5/2002 Burgard ..... A44C 17/0208 63/3.1
6,571,579 B1 * 6/2003 Rissin ..... A44C 7/00 63/12

(Continued)

FOREIGN PATENT DOCUMENTS

KR 101795714 B1 * 1/2006 ..... A44C 7/002
KR 102153868 B1 * 3/2019 ..... A44C 7/003

*Primary Examiner* — Emily M Morgan
(74) *Attorney, Agent, or Firm* — Brion Raffoul

(57) ABSTRACT

An earring having an earring back to securely attach an accessory. The earring back is designed to securely retain the accessory within an enclosure by means of a shaft of a stud earring. The accessory may be a hooped accessory.

12 Claims, 7 Drawing Sheets

(56) References Cited

U.S. PATENT DOCUMENTS

| | | | | |
|---|---|---|---|---|
| 6,729,159 | B2 * | 5/2004 | Rose | A44C 17/0208 63/3.1 |
| 7,155,932 | B2 | 1/2007 | Renter | |
| D727,778 | S * | 4/2015 | Levinson | A44C 7/003 D11/86 |
| 9,226,552 | B1 * | 1/2016 | Makhoulian | A44C 7/003 |
| D826,080 | S * | 8/2018 | Gentile | D11/88 |
| D891,975 | S * | 8/2020 | Drossman | D11/88 |
| D924,098 | S * | 7/2021 | Wright | D11/86 |
| 2001/0045105 | A1 * | 11/2001 | Takessian | A44C 25/00 63/29.1 |
| 2008/0148773 | A1 * | 6/2008 | Thurber | A44C 7/002 63/36 |
| 2008/0148774 | A1 * | 6/2008 | Thurber | A44C 7/002 63/13 |
| 2010/0251769 | A1 * | 10/2010 | Samuels | A44C 11/005 63/23 |
| 2021/0068506 | A1 * | 3/2021 | Nguyen | A44C 13/00 |

* cited by examiner

EARRING AND EARRING BACK

TECHNICAL FIELD

The present invention relates to earrings. More specifically, the present invention relates to a secure means for attaching an accessory to an earring.

BACKGROUND

As is well known, earrings are pieces of jewellery to be worn on, in, or around an ear of an individual. Earrings are commonly worn by inserting a portion of the earring into a hole pierced into an ear of an individual.

Earrings worn as piercings are not inherently secure. For example, a shaft merely placed through a pierced earlobe can easily fall out of the pierced hole. An unsecured earring can quickly be lost, causing the wearer distress. Further, a lost earring can become a hazard to children or animals in the vicinity.

Various means exist for securing an earring to the wearer's ear. For example, many earrings use hooks. An ornamental pendant or a similar accessory is attached to one side of the hook. The hook is then inserted through an earlobe, thus holding the earring in place. However, the earring can easily fall out of the ear if the hook experiences vertical forces, such as during physical activity.

Hoop earrings often use hinged latches to secure the earring. A hinged shaft is lifted from one side of the hoop, is inserted through the pierced hole, and is then lowered into a latch on the other side of the hoop. Similar to hooks, hinged latches can easily be dislodged by vertical forces.

A friction earring back piece is a more secure way of attaching an earring to a wearer's ear. Such friction back pieces are used with stud earrings. A friction earring back is placed on the inner surface of the ear, and the shaft of the stud earring is inserted through the pierced hole into an opening in the friction earring back. The shaft is retained by friction between flanges on the friction earring back and the shaft of the stud earring. Other mechanisms for securing earrings to a user's ear also exist.

However, none of the existing earring backs secure further accessories. For example, such an earring back would not secure a hooped accessory to a stud earring. Additionally, the range of styles available for stud earrings is relatively limited. Thus, there is a need for an earring with an earring back that can securely attach additional accessories to the ear.

SUMMARY

This document discloses an earring having an earring back to securely attach an accessory. The earring back is designed to securely retain the accessory within an enclosure by means of a shaft of a stud earring. The accessory may be a hooped accessory.

In a first aspect, this document discloses an earring having an earring back to securely attach an accessory, said earring back comprising: a base, wherein said base has an opening constructed to receive a shaft of a stud earring; and wherein said opening is located at a central portion of said base, a retention component for retaining said shaft with said base, wherein, when said shaft is inserted into said opening and said retention component is engaged, said shaft is secured to said base; two flat members originating from said base, wherein said two flat members are separated by a width greater than a width of said opening, wherein said two flat members extend away from said base and loop towards the base, thereby defining an enclosure, wherein said two flat members continue from said loop and parallel to said base to form a channel between said flat members and said base, wherein said enclosure is configured to allow said accessory to be held within said enclosure, wherein said base and said two flat members are separated by a distance such that said distance forms a channel, wherein said accessory is threadable through said channel, wherein when said earring is assembled with said earring back and said accessory, said accessory is securely held in said enclosure.

The present invention may be implemented such that when said earring is assembled, said shaft prevents the removal of said accessory from said earring back.

The present invention may be implemented such that said two flat members converge to join one another at a point that is distal from said enclosure.

The present invention may be implemented such that said channel resiliently expands to allow said accessory to be securely held in said enclosure.

The present invention may be implemented such that said accessory is a hooped accessory.

The present invention may be implemented such that said hooped accessory further comprises a crossbar mounted on said hooped accessory such that said crossbar is perpendicular to and tangential to an outer rim of the hooped accessory.

The present invention may be implemented such that when said hooped accessory is assembled, said crossbar is captured within said enclosure.

The present invention may be implemented such that a material of said earring back is selected from the group consisting of: gold, platinum, silver, nickel, titanium, stainless steel, plastic, copper, and combinations thereof.

In another aspect, the present invention may be implemented such that the retention component is integrated with said base. For such an implementation, the retention component may comprise two flanges extending from opposite ends of the base and wherein the two flanges curl from said base towards the central portion to engage the shaft after the shaft is inserted into said opening, Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached figures as follows.

DETAILED DESCRIPTION

This document discloses an earring comprising an earring back for securely attaching an accessory to an earring. The earring can use a stud earring with the earring back to retain, for example, a hooped accessory.

Figure 1:
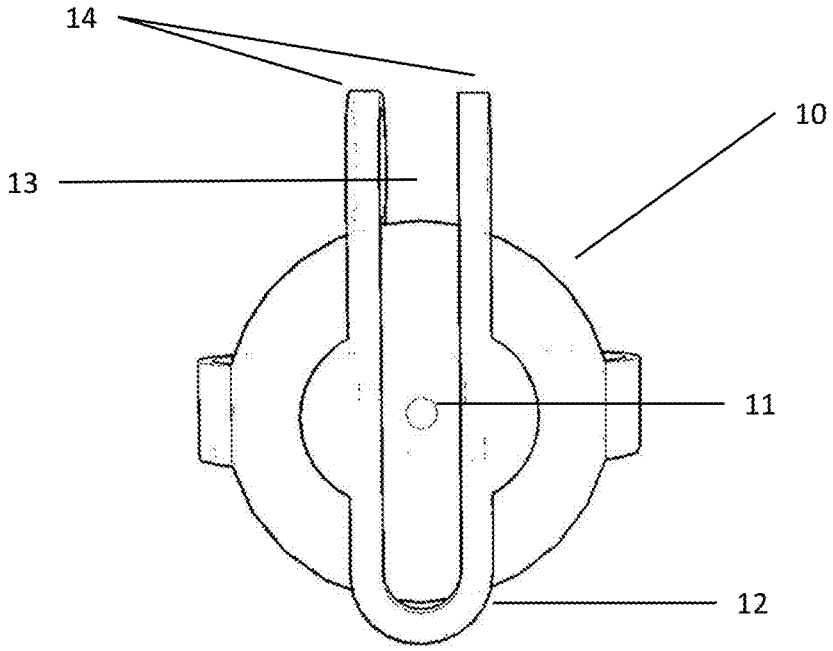
FIG. 1 is a front view of the earring back according to an example embodiment.
Figure 4:
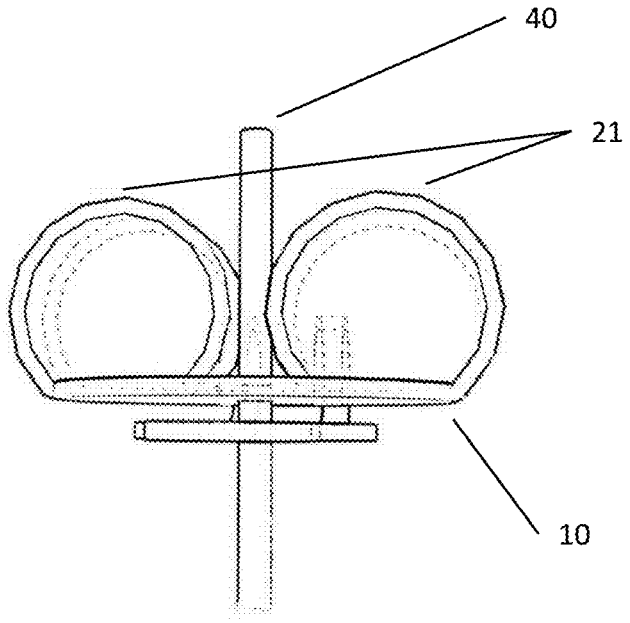
FIG. 4 is a top view of an embodiment of an earring back assembled with the shaft of a stud earring.
Figure 5:
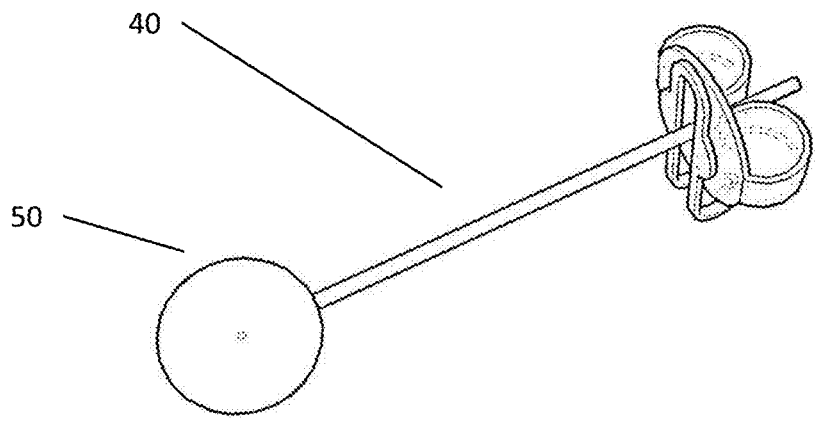
FIG. 5 is a perspective view of an embodiment of the earring back assembled with a stud earring.

Referring now to FIG. 1, a base 10 of the earring back is shown. In one embodiment, the base 10 has a substantially flat circular shape. An opening 11 is present in a central portion of the base 10. The opening 11 allows for the insertion of a shaft 40 of a stud earring 50, as shown in FIG. 4 and FIG. 5. As would be clear to a wearer, the shaft 40 is designed to pass through a pierced hole in the ear/earlobe of the wearer.

Two flat members 14 extend from the base 10. The two flat members 14 are parallel to one another and are separated by a width 13 greater than that of the opening 11. The width 13 is greater than that of the opening 11 so as to prevent the occlusion of the opening 11 by the two flat members 14.

Figure 3:
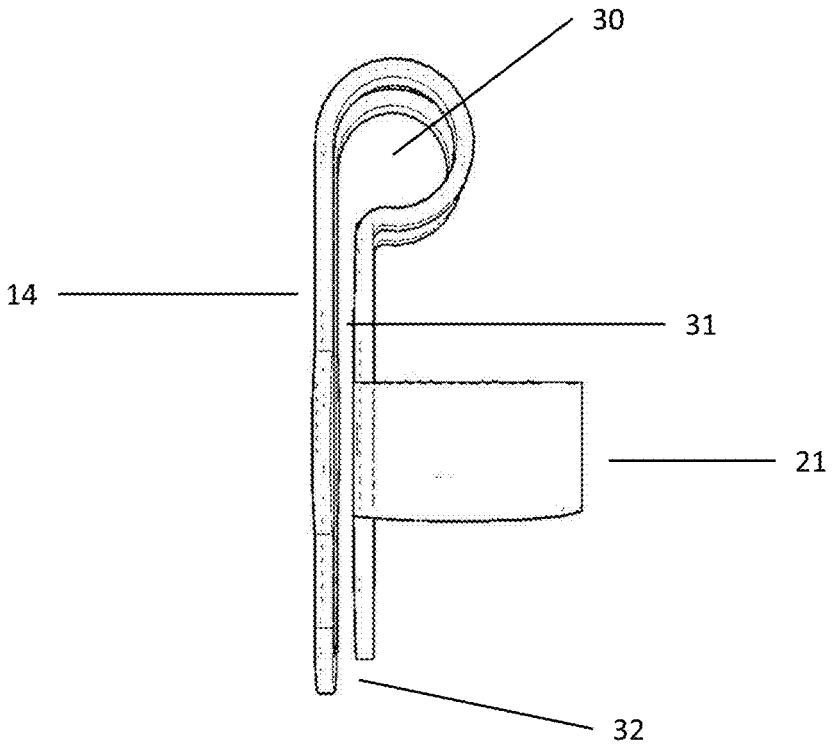
FIG. 3 is a side view of the embodiment according to FIG. 1.

As mentioned above, the two flat members 14 extend from the base 10. The two flat members 14 then loop back towards the base, forming an enclosure 30 as shown in FIG. 3. In various embodiments, the enclosure 30 may be curved, substantially circular, substantially square, or may be another shape suitable to retain an accessory. The enclosure 30 operates as a detent to the accessory to thereby hold the accessory within the enclosure.

The two flat members 14 continue from the loop and extends so as to be parallel to the base 10. The two flat members continue past the opening 11. In an embodiment, the two flat members 14 converge at a point 12 distal from the enclosure 30. The convergence 12 of the two flat members 14 may form, for example, a U-shape, a V-shape, a substantially square end, or any other suitable shape that connects the two ends of the flat members 14. The shape may be chosen for its function, or to the personal taste of the wearer.

Figure 2:
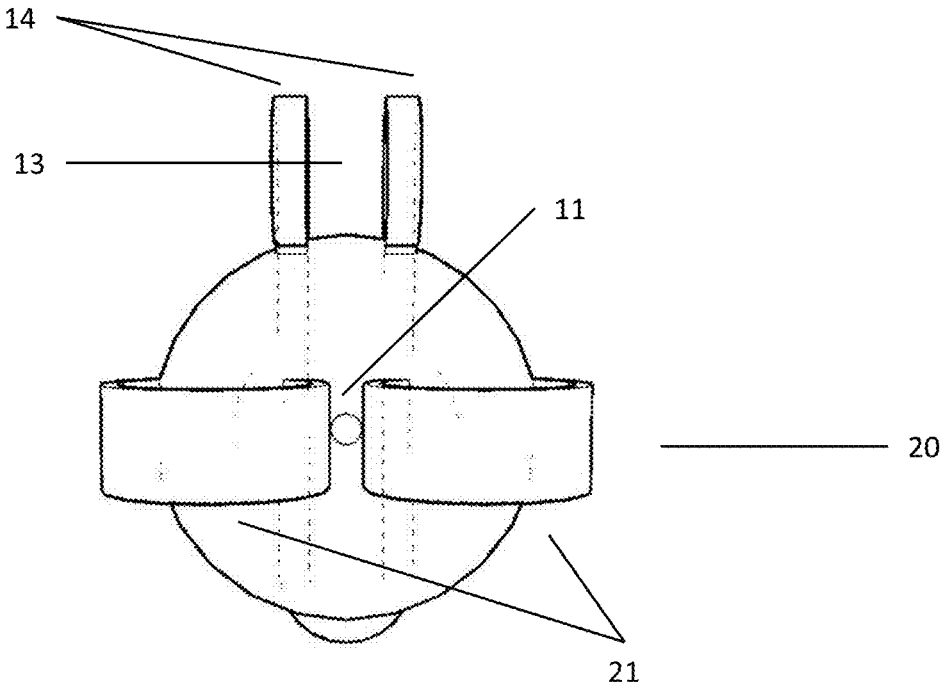
FIG. 2 is a back view of the embodiment according to FIG. 1.

Referring now to FIG. 2, a back view of the earring back is shown. The base 10 is integrated with a retention component 20. The retention component 20 comprises two flanges 21. These flanges 21 curl out and away from the base 10. The flanges curl further back towards the base such that each curled flange forms a ring. When the shaft 40 of a stud earring 50 is assembled with the earring back through the opening 11, the two ring flanges 21 engage the shaft 40. The flanges 21 are configured to secure the shaft 40 while the wearer is wearing the earring. As can be seen from FIG. 2, the two flanges 21 are separated by a space through which the opening 11 can be seen. This space, preferably, has a width that is less than the diameter of the shaft 40 such that, when the shaft 40 is assembled with the base and has been inserted into the opening 11, the sides of the shaft 40 are engaged by the flanges 21. This engagement can be seen in FIG. 4.

It should be clear that, although the embodiment in FIG. 2 uses two ring flanges to engage the shaft, other mechanisms to secure/engage the shaft of the stud earring to the base may be used. As examples, mechanisms that do not use compression may be used. Mechanisms that use a friction-based lock or a screw mechanism to secure the shaft of the stud earring to the base may be used. As well, any mechanism that does not impede the other features of the invention but which secures the shaft of the stud earring to the base may be used. In one example, instead of ring flanges that engage the shaft as shown in FIG. 4, the shaft may be threaded to engage with cooperating threads on a threaded nut or ball that secures the shaft to the base. As well, a well-known screw flat back or a threaded post screw back mechanism or configuration may be used to secure the shaft to the base. Similarly, a cap (e.g. made of plastic or other suitable material) that attaches to the end of the shaft (after the shaft is placed through the base) by a friction based mechanism may also be used.

Referring now to FIG. 3, a side view of the earring back is shown. As can be seen, the ring flanges 21 are on one side of the base 10 while the sections of the two flat members 14 that extend from the enclosure are on the other side of the base. Additionally, a channel 31 forms between the base 10 and the sections of the two flat members 14 that extend from the enclosure. These sections of the two flat members 14 are parallel to the base 10. An entrance 32 is formed at the end of the channel 31 that is distal to the enclosure 30.

When the user wishes to wear an accessory, the accessory is inserted through the entrance 32. The accessory is then threaded through the channel 31 to be retained or detained in the enclosure 30. The shaft 40 of a stud earring 50 is then inserted through the opening 11 and is retained or engaged by the flanges 21. After insertion of the shaft 40, the accessory cannot be removed through the channel 31 unless the shaft 40 is removed first as the shaft 40 prevents the accessory is prevented from travelling through the channel 31. Thus, the accessory is securely retained in the enclosure 30. In one embodiment, the width of the channel is sufficient to allow the accessory to be threaded through the channel without the need for the channel to resiliently expand.

In one embodiment, the width of the channel 31 is such that the accessory is unable to fit through the channel without the channel resiliently expanding. For this embodiment, the two flat members 14 are resilient such that the channel 31 resiliently expands during the threading of the accessory. The enclosure acts as a spring to provide the resilience which may be necessary to allow the channel to suitably expand and allow the accessory to travel through the channel. Once the accessory is in the enclosure, the channel springs back to its original size that is, as explained above, a size that is insufficient to allow the accessory to travel through the channel. This sizing of the channel and its resilience can provide an additional means for retaining the accessory when the accessory is in the enclosure 30.

Figure 6:
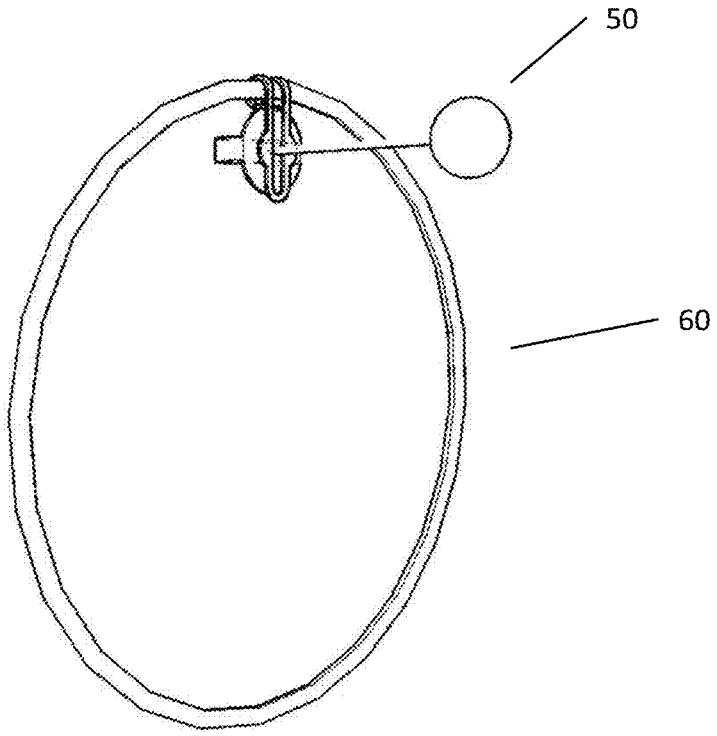
FIG. 6 is a perspective view of the embodiment according to FIG. 5 assembled with a hooped accessory.

Referring to FIG. 5 and FIG. 6, the stud earring is illustrated with the shaft of the stud earring being deployed through the opening of the base. This ensures that the shaft is securely held/retained to the base when the retention component is engaged to the shaft. As should be clear, the retention component in the figures are the two ring flanges as the ring flanges engage and secure the shaft when the shaft is deployed between the ring flanges. Other retention components or retention mechanisms may also be used. Such retention components may include screw back mechanisms, screw flat back mechanisms, a threaded nut/ball, and a cap. When the earring is worn on a user's ear, the shaft passes through a piercing on the user's ear and the user's ear is captured between the base and the stud earring.

Many types of accessories can be used with the earring, such as barbell-type earring accessories. One type of accessory that can be used is a hooped accessory 60, as shown in FIG. 6. Depending on the wearer's preference, the earring back can be oriented in different positions. In one embodiment, the enclosure 30 is above the earlobe of a user when the earring is worn. In such an embodiment, the joined tips of the flat members 14 would be pointed towards the centre of the hooped accessory 60.

Figure 7A:
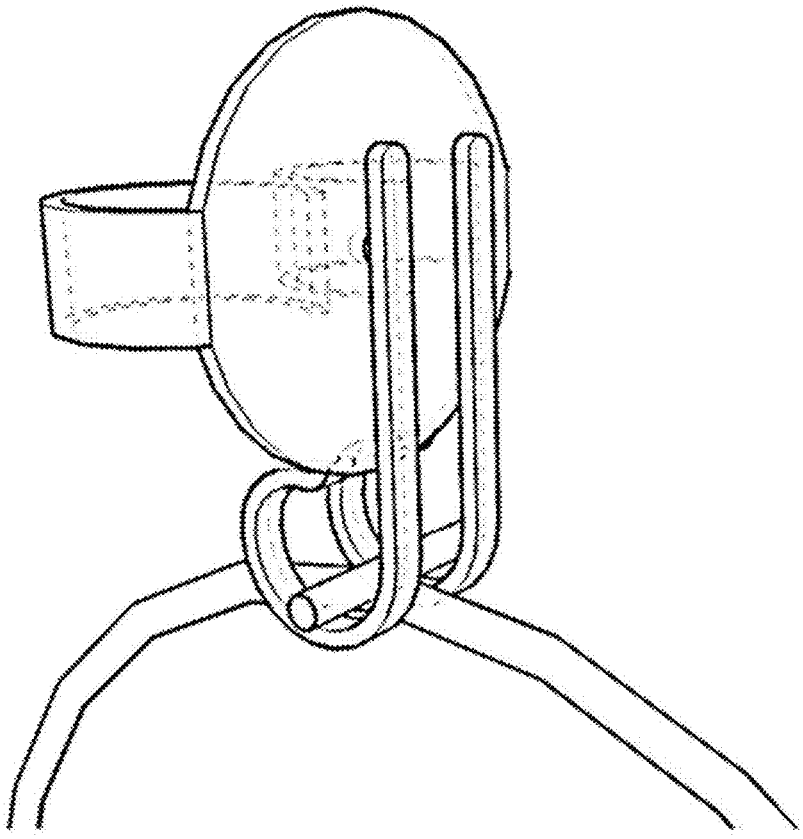
FIGS. 7A-7D are different views of another embodiment of the present invention where the hooped accessory uses an integrated crossbar.
Figure 7B:
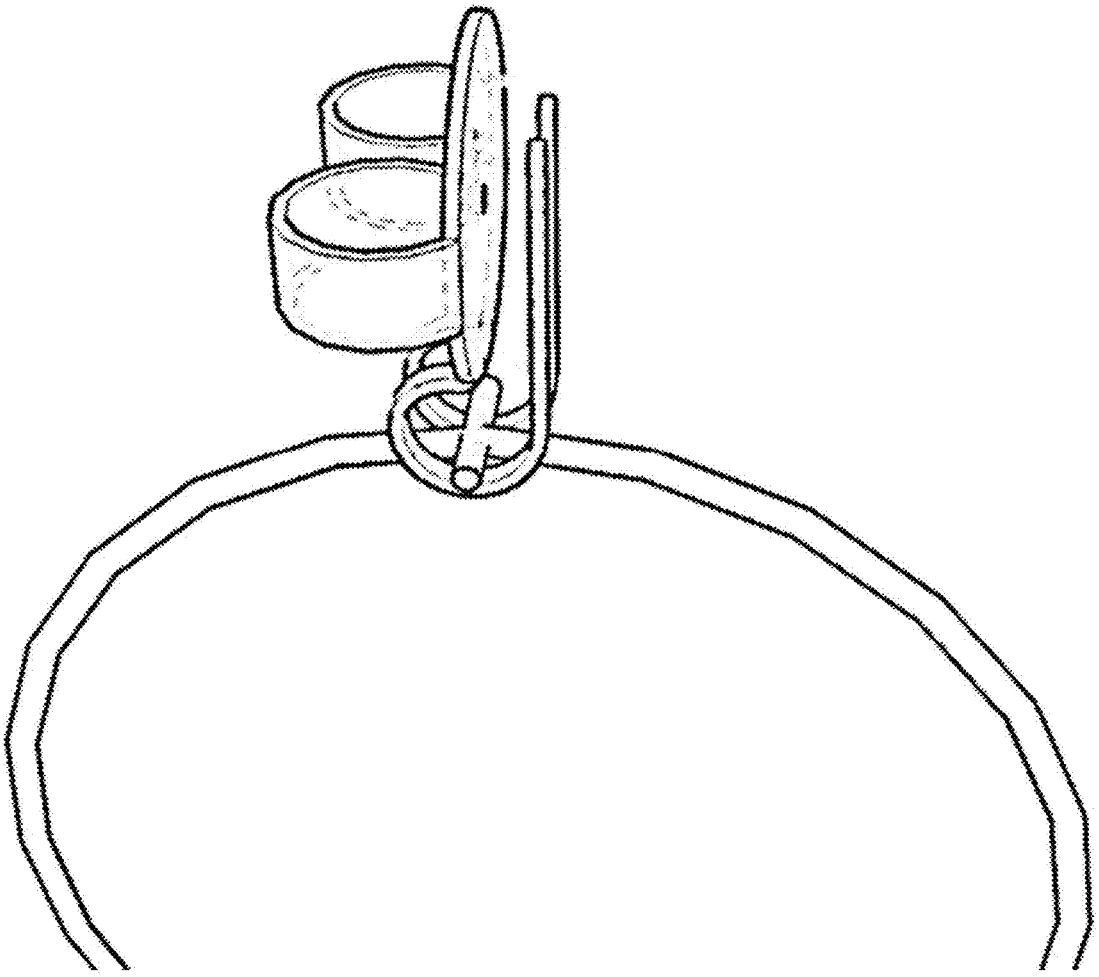
Figure 7C:
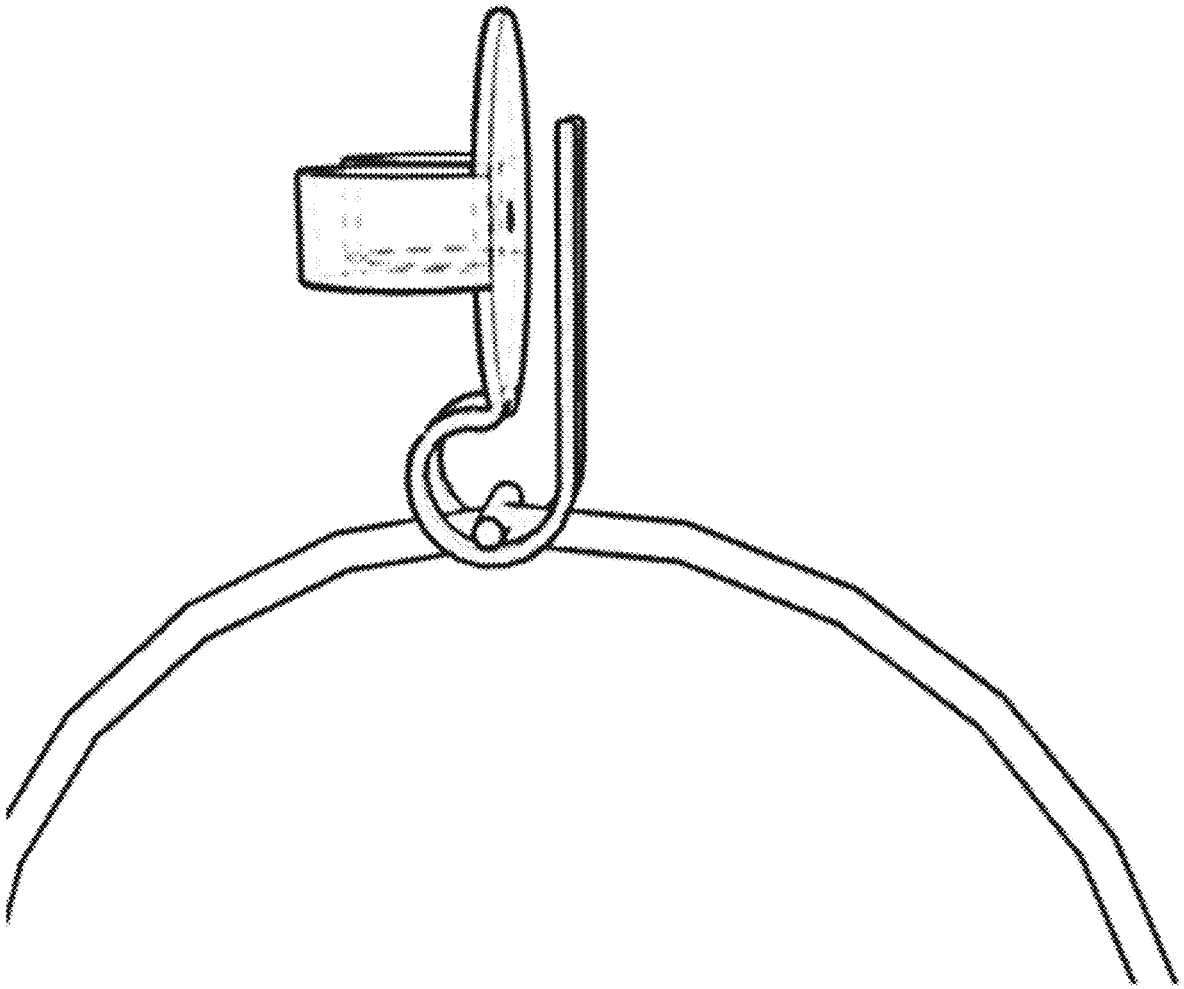
Figure 7D:
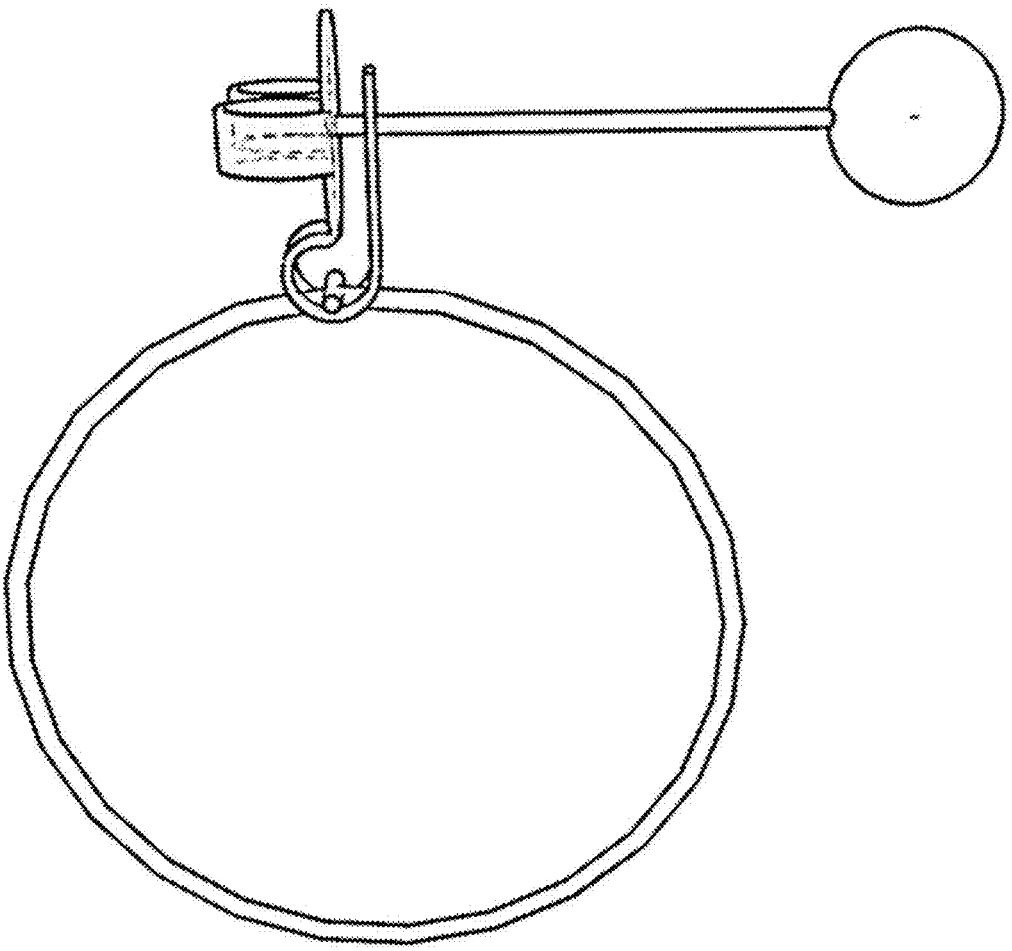

The hooped accessory 60 can have varying embodiments. In one such embodiment, the hooped accessory 60 further comprises a crossbar. The crossbar can be mounted to the rest of the hooped accessory 60 such that the crossbar is tangential to and perpendicular to the outer rim of the hooped accessory 60. The crossbar portion of the hooped accessory 60 can then be threaded through the channel 31 and captured in the enclosure 30. This embodiment is illustrated in the detail of FIG. 7A. For greater clarity, FIG. 7B is provided. As can be seen in FIG. 7B, the crossbar is mounted directly on to the outer rim of the hooped accessory 60 and the crossbar is captured/retained within the enclosure. FIG. 7C provides a sideview of the crossbar as captured/retained within the enclosure. FIG. 7D illustrates the crossbar embodiment of the accessory with the shaft of the stud earring illustrated as being inserted through the base. As was noted above, while the above embodiment illustrate a friction/compression based mechanism to secure the shaft of the stud earring to the base, other mechanisms (including screw mechanisms) may also be used.

As should be clear, the earring, including the earring back, and the accessory can be made out of one or more materials commonly used to fashion earrings. For example, gold, platinum, silver, nickel, titanium, stainless steel, plastic, and/or copper are commonly used in earrings. It should also be clear that more than one material can be used, such as in an alloy or in different parts of the invention.

For a better understanding of the present invention, the following references may be consulted. Each of these references is hereby incorporated by reference in its entirety:

[1] U.S. Pat. No. 3,443,398 to King;

[2] U.S. Pat. No. 5,588,309 to Chioffe;

[3] U.S. Pat. No. 7,155,932 to Renter; and

[4] U.S. Pat. No. 9,226,552 to Makhoulian et al.

The expression 'at least one of X and Y', as used herein, means and should be construed as meaning 'X, or Y, or both X and Y'.

A person understanding this invention may now conceive of alternative structures and embodiments or variations of the above all of which are intended to fall within the scope of the invention as defined in the claims that follow.

I claim:

1. An earring comprising an earring back, an accessory, and a stud having a shaft, said earring back being for securely attaching said accessory, said earring back comprising:

a base, wherein said base has an opening constructed to receive said shaft of said stud and wherein said opening is located at a central portion of said base, a retention component for retaining said shaft with said base, wherein, when said shaft is inserted into said opening and when said retention component is engaged, said shaft is secured to said base, said retention component comprising two flanges extending from opposite ends of said base, wherein said two flanges curl from said base towards said central portion to engage said shaft when said shaft is inserted into said opening;

two flat members originating from said base, wherein said two flat members are separated by a width greater than a width of said opening, wherein said two flat members extend away from said base and curl back towards the base, thereby defining an enclosure, wherein said two flat members continue from said enclosure and extend to be parallel to said base to thereby form a channel between said flat members and said base, said channel being on an opposite side of said base from said flanges, wherein said enclosure is configured to allow said accessory to be held within said enclosure, wherein said base and said two flat members are separated by a distance such that said distance forms said channel, wherein said accessory is configured to be retained in said enclosure, wherein, when said earring is assembled with said earring back and said accessory, said accessory is securely held in said enclosure, and wherein said opening is located on said base such that, when said earring is assembled, said shaft prevents the removal of said accessory through said channel.

2. The earring according to claim 1, wherein said two flat members converge to join one another at a point that is distal from said enclosure.

3. The earring according to claim 1, wherein said channel resiliently expands to allow said accessory to be securely held in said enclosure.

4. The earring as claimed in claim 1, wherein said accessory is a hooped accessory.

5. The earring according to claim 4, wherein said hooped accessory is secured within said enclosure such that said two flat members prevent removable of said accessory from said enclosure.

6. The earring according to claim 4, wherein said hooped accessory further comprises a crossbar mounted on said hooped accessory such that said crossbar is tangential to and perpendicular to an outer rim of said hooped accessory.

7. The earring according to claim 6, wherein, when said hooped accessory is assembled, said crossbar is captured within said enclosure.

8. The earring according to claim 1, wherein a material of said earring back is selected from the group consisting of: gold, platinum, silver, nickel, titanium, stainless steel, plastic, copper, and combinations thereof.

9. The earring according to claim 1, wherein said retention component is integrated with said base.

10. The earring according to claim 1, wherein said enclosure is outside a perimeter of said base.

11. The earring according to claim 1, wherein, when said accessory is within said enclosure, said accessory is outside said perimeter of said base.

12. The earring according to claim 1, wherein said accessory is passable through said channel and wherein a width of said channel is such that, when said accessory passes through said channel, said channel resiliently expands, and wherein said enclosure acts as a spring to thereby provide a resilience such that said channel expands when said accessory passes through said channel and said channel returns to an original width after said accessory passes through said channel.

* * * * *